US007314026B2

(12) United States Patent
Koneda et al.

(10) Patent No.: US 7,314,026 B2
(45) Date of Patent: Jan. 1, 2008

(54) ELECTRONIC VALVE ACTUATOR HAVING HYDRAULIC DISPLACEMENT AMPLIFIER

(75) Inventors: Philip Koneda, Novi, MI (US); Thomas Megli, Dearborn, MI (US); James Ervin, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/761,865

(22) Filed: Jan. 21, 2004

(65) Prior Publication Data

US 2005/0155564 A1 Jul. 21, 2005

(51) Int. Cl.
*F01L 9/02* (2006.01)

(52) U.S. Cl. ..... 123/90.11; 123/90.12; 123/90.13

(58) Field of Classification Search .. 123/90.11–90.13, 123/90.15–90.17; 310/12, 14, 15, 17; 251/12, 251/129.01, 129.15, 129.16, 129.18, 129.19, 251/15, 16
See application file for complete search history.

(56) References Cited

U.S. PATENT DOCUMENTS

| | | | | |
|---|---|---|---|---|
| 3,108,777 | A * | 10/1963 | Ray | 251/54 |
| 3,548,793 | A | 12/1970 | Richardson | |
| 5,119,773 | A | 6/1992 | Schon et al. | |
| 5,161,494 | A | 11/1992 | Brown, Jr. | |
| 6,192,841 | B1 | 2/2001 | Vorih et al. | |
| 6,202,607 | B1 | 3/2001 | Kreuter | |
| 6,262,498 | B1 | 7/2001 | Lieber | 310/12 |
| 6,276,317 | B1 * | 8/2001 | Yoeda et al. | 123/90.11 |
| 6,325,028 | B1 | 12/2001 | Albanello et al. | |
| 6,354,253 | B1 * | 3/2002 | Katsumata et al. | 123/90.11 |
| 6,371,064 | B2 * | 4/2002 | Hartke et al. | 123/90.11 |
| 6,539,901 | B2 * | 4/2003 | Nishida et al. | 123/90.11 |
| 6,997,433 | B2 | 2/2006 | Koneda et al. | |
| 2003/0160197 | A1 * | 8/2003 | Kodama | |

FOREIGN PATENT DOCUMENTS

| | | |
|---|---|---|
| EP | 0 970 299 | 1/2000 |
| EP | 0970295 | 6/2001 |
| EP | 0970299 | 6/2001 |
| JP | 2223612 | 9/1990 |

* cited by examiner

*Primary Examiner*—Ching Chang

(57) ABSTRACT

An electronically controlled valve actuator having a hydraulic lever in the form of a fluid filled chamber, is used to amplify the motion of a magnetic armature and thereby achieve a desired valve displacement with reduced effective travel of the armature, reduced transition time and power consumption while incorporating passive hydraulic lash adjustment in the hydraulic lever mechanism.

16 Claims, 6 Drawing Sheets

ELECTRONIC VALVE ACTUATOR HAVING HYDRAULIC DISPLACEMENT AMPLIFIER

TECHNICAL FIELD

This invention relates generally to electronic valve actuators, and more particularly to electronic valve actuators having displacement amplifiers.

BACKGROUND

As is known in the art, one common approach to electronically control the valve actuation of an internal combustion engine is to have two electromagnets toggle an armature connected to the valve between an open position and a closed position. More particularly, referring to FIG. 1, when a first, here upper, one of the electromagnets is activated, the armature is attracted to the activated electromagnet thereby driving the valve to move to its closed position. Also, as the armature is attracted to the activated electromagnet, a first spring, in contact with the upper end of the armature is compressed. When the first electromagnet is deactivated, the first compressed, spring releases its stored energy and drives the armature downward thereby driving the valve towards it open position. As the armature approaches the second, lower, electromagnet, the second electromagnet is activated driving the valve to its full open position. It is noted that a second, lower spring becomes compressed during the process. After becoming fully open, the second electromagnet is deactivated, and the lower spring releases its stored energy to thereby drive the armature towards its upper position, the first electromagnet is activated and the process repeats. Thus, the two electromagnets toggle the armature connected to the valve between an open or closed position where it is held, while the pair of springs is used to force the valve to move (oscillate) to the other state (FIG. 1).

One problem with the approach described above is that, in the presence of high friction or gas force loads on the valve, the magnets must generate force over a significant fraction of the valve stroke. At points of travel where the gap (i.e., the "air gap") between the activated magnet and the portion of the armature experiencing the magnetic force produced by the activated electromagnet (i.e., the attractive magnetic force) is large, high current is required to achieve the required attractive forces. This increases power consumption. The peak force that can be practically generated is reduced as the air gap increases thereby effectively reducing the authority to control the valve motion.

As noted from FIG. 1, with the exception of a small lash gap $\delta$ between the armature and valve stem at the closed position, there is a one-to-one relationship between the distance, Z, traveled by the armature and the distance traveled by the valve. Thus, from a neutral position $Z=0$ shown the middle portion of FIG. 1, to the fully closed position, shown in the left portion of FIG. 1, the armature moves a distance, $Z=-L/2$. Likewise, from the neutral position shown the middle portion of FIG. 1, to the fully closed position, shown in the right portion of FIG. 1, the armature moves a distance, $Z=+L/2$. Thus, the armature moves a distance of L and the valve moves a distance $L-\delta$ during each open-close cycle.

An alternative to this direct acting linear (i.e., one-to-one) oscillator, is shown in FIG. 2. Here, the actuator uses a mechanical lever to amplify the travel distance of the armature and thereby reduce the effective air gap. For example, with the magnets disposed about half way along the lever arm, such portion of the lever arm need only be displaced a distance L/2 in order to achieve a valve displacement of $L-\delta$ during an open-closed valve cycle. As a result of the reduced gap, the lever system does improve the control authority through the stroke and improves the power consumption relative to conventional linear oscillators.

However, as is also known in the art, existing designs have limited peak engine operating speed due to limited valve transition times (i.e., time from fully open to fully closed or vice-versa). For good durability and low noise, existing designs require complex feedback control algorithms to achieve low impact velocities during valve seating, armature seating, and lash take-up. Control schemes to date use high-speed (approximately 10-50 kHz control loop frequencies) computing power, and high-resolution position and current sensors for each valve. The algorithms are highly complex, and will likely require adaptive or iterative learning control schemes to both reduce calibration effort and to compensate for changes in actuator and valve characteristics over the life of the engine. To date, the poor robustness and high cost of such schemes make implementation impractical. The systems shown in FIG. 1 and FIG. 2 do not address issues of passive lash management or passive damping and have limited packaging flexibility and ability to optimize the design.

SUMMARY

In accordance with the present invention, an electronic valve actuator is provided having an electromagnet and an armature disposed adjacent to the electromagnetic. The actuator includes a fluid-containing chamber having: a first piston providing a first wall portion of the chamber; and a second piston providing a second wall portion of the chamber. The first wall portion has a greater surface area than the surface area of the second wall portion. The first piston is coupled to the armature and the second piston is coupled to a valve.

With such an arrangement, displacement of one of the pair of pistons is amplified in the chamber by the ratio of the surface areas of the pistons thereby reducing the air gap compared with a direct drive system.

In one embodiment, a pair of electromagnets is provided. The armature is disposed in a magnetic field produced by the pair of electromagnets. A pair of springs is included. A first one of the pair of springs is disposed to compress upon activation of a first one of the pair of electromagnets while a second one of such pair of springs is disposed to expand upon such activation of the first one of the pair of electromagnets. The first one of the springs is held in compression until deactivation of the first one of the electromagnets. The second one of the pair of springs is disposed to compress after deactivation of the first one of the electromagnets and resulting expansion of the first one of the pair of springs while the first one of such pair of springs is disposed to thereby expand. The second one of the springs is held in compression until deactivation of the second one of the electromagnets.

In one embodiment, a valve disposed in the wall of the fluid-containing chamber for enabling such chamber to receive fluid when volume of such chamber is increased by activation of one of electromagnets to move one of the pistons in a first direction and to inhibit removal of such fluid from the chamber when volume of such chamber is decreased by activation of said one of the pistons in an opposite direction.

In one embodiment, the valve enables the chamber to receive fluid when volume of such chamber is increased by activation of one of electromagnets to move one of the pistons in a first direction and to inhibit removal of such fluid from the chamber when volume of such chamber is decreased by activation of said one of the pistons in an opposite direction.

With such an arrangement, lash take-up is provided.

In one embodiment, a second fluid-containing chamber is included to provide a conduit for fluid therein to pass between an outer surface portion of the first piston and an outer surface portion of the second piston as the first and second pistons move in response to activation of the first and second ones of the pair of electromagnets.

With such an arrangement, passive damping is provided enabling a simple damping control system.

In one embodiment, the fluid in the second chamber passes to the first-mentioned fluid-containing chamber through the valve.

Thus, the inventors have recognized that use of a hydraulic lever to amplify the motion of a magnetic armature achieves a desired valve displacement, reduces the effective travel of the armature, reduces transition time and power consumption while incorporating passive hydraulic lash adjustment in the hydraulic lever mechanism. This thereby eliminates the need for complex feedback control to achieve low impact velocities during lash take-up. Further, incorporation of passive hydraulic damping in the hydraulic lever mechanism enables use of a robust low cost open loop armature and valve landing control or improves the robustness of a simplified closed loop control.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figures 3, 3A:
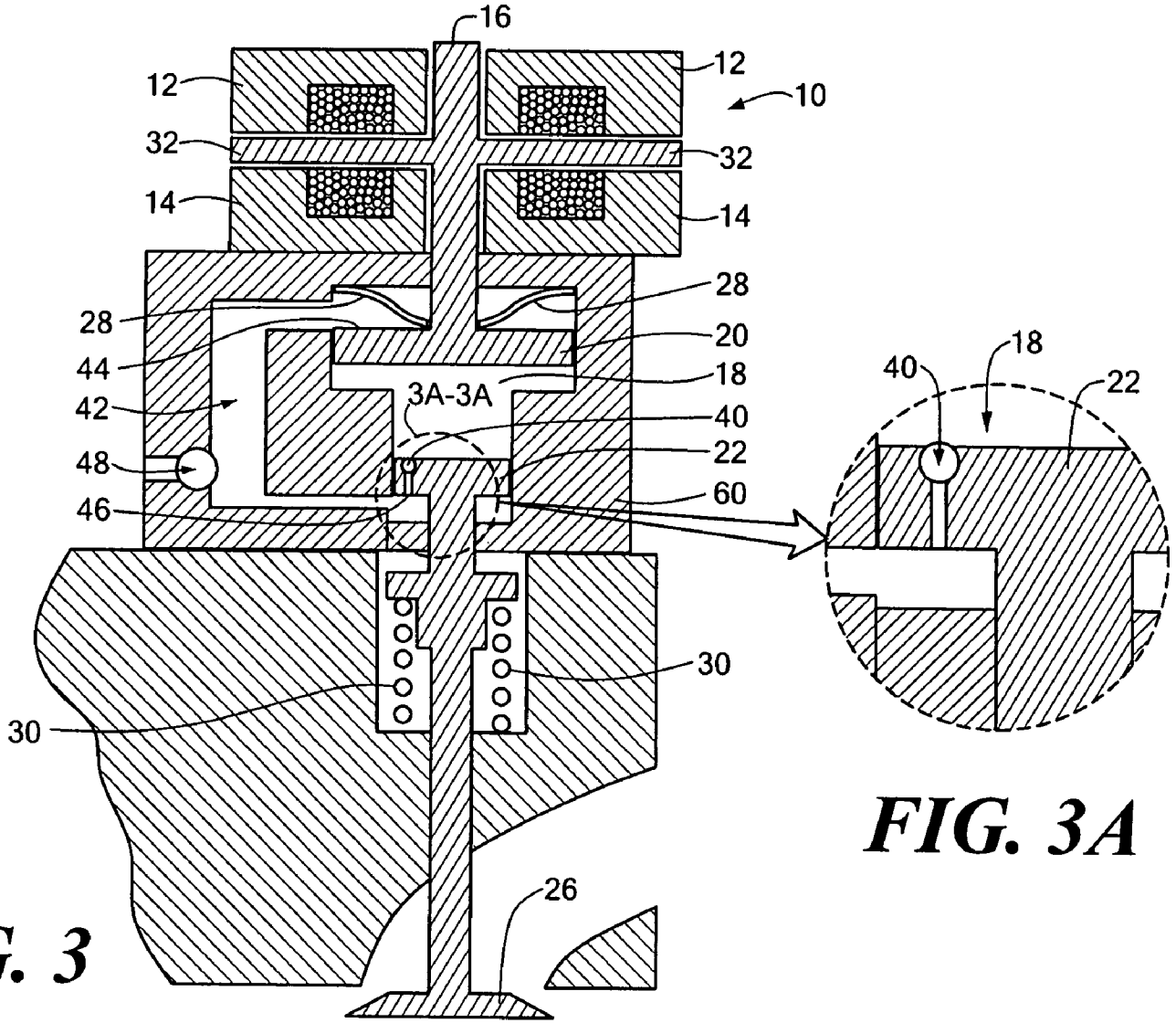
FIG. 3 is an electronic valve actuator according to the invention.
FIG. 3A is an exploded portion of the electronic valve actuator of FIG. 3, such portion being enclosed by the circle in FIG. 3 labeled 3A-3A.

Referring now to FIG. 3, an electronic valve actuator 10 is shown to include a pair of electromagnets 12, 14. An armature 16 is disposed in a magnetic field, not shown, produced by the pair of electromagnets 12, 14. The actuator 10 also includes a fluid-containing chamber 18, herein also referred to as inner cavity 18. The inner cavity 18 has a first piston 20 providing a first wall portion of the inner cavity 18 and a second piston 22 providing a second wall portion of the inner cavity 18, as shown. The first wall portion provided by first piston 20 is greater in surface area (A1) than the surface area (A2) provided by the second wall portion provided by the second piston 22. The first piston 20 is coupled to the armature 16, here integrally formed as a single piece with the armature 16, and the second piston 22 is coupled to a valve 26, here integrally formed as a single piece with the valve 26. The actuator 10 also includes a pair of springs 28, 30. A first one of the pair of springs 28, 30, here spring 28 a Belleville spring, is disposed to compress upon activation of a first one of the pair of electromagnets 12, 14, here upon activation of upper electromagnet 12, while a second one of such pair of springs 28, 30, here a coil spring 30, is disposed to expand upon activation of the upper electromagnet 12, i.e., when a plate 32 of armature 16 is attracted and drawn upward by the actuated upper magnet 12. The second one of the pair of springs 28, 30, here spring 30 a coil spring, is disposed to compress upon activation of the lower electromagnet 14, while the upper spring 28, is disposed to expand upon activation of the lower electromagnet 14, i.e., when the plate 32 of armature 16 is attracted and drawn downward by expansion of the upper spring 28.

A valve 40, here a check valve shown in more detail in FIG. 3A, is disposed in the wall of the fluid-containing chamber 28, here in the lower piston 22, for enabling such chamber 28 to receive fluid, here hydraulic fluid of the internal combustion engine, not shown, having the valve actuator 10, when volume of such chamber 28 is increased by activation of the upper electromagnet 12 to move the first, upper piston 20 in an upward direction. The check valve 40 is disposed to inhibit removal of such fluid from the chamber 28 when volume of such chamber 28 is decreased by a downward motion of the upper piston 20 upon deactivation of the upper electromagnet 12 and the expansion of the upper spring 28 upon deactivation of the lower electromagnet 14 in a manner to be described below.

The electronic valve actuator 10 includes a second, outer, fluid-containing chamber 42 providing a conduit for fluid therein to pass between an outer surface portion 44 of the first, upper piston 20 and an outer surface portion 46 of the second, lower piston 22 as the first and second pistons 20, 22 move in response to activation or deactivation of the first and second ones of the pair of electromagnets. The fluid in the second chamber 42 passes to the inner fluid-containing chamber 18 through the valve 40. The hydraulic fluid, here engine oil, enters the outer chamber 42 through a valve 48.

More particularly, the upper hydraulic piston 20 is attached to the armature 16 and is biased with the upper (armature) spring 28 to be urged in a downward position while a lower piston 22 is attached to the valve 26 and biased in an upward position by spring 30.

Figure 4B:
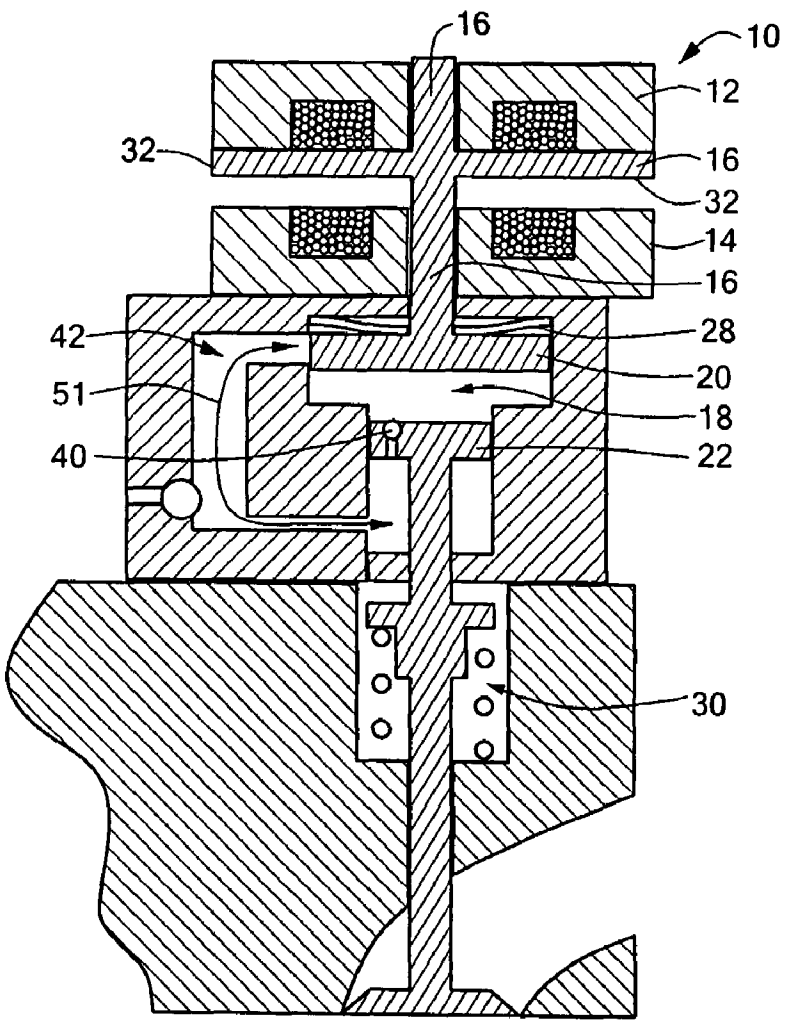
FIGS. 4A-4D show positions of elements in the electronic valve actuator of FIG. 3 at various stages in the operation of such actuator.
Figure 4A:
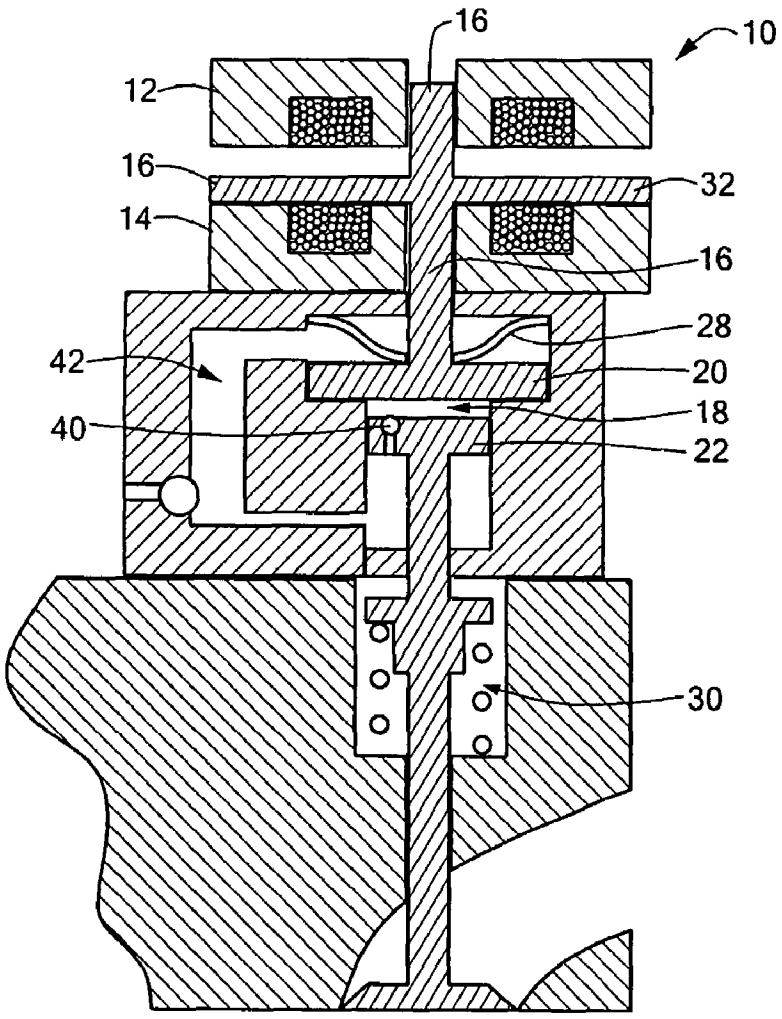

In operation, and referring now to FIG. 4A, during a startup sequence, the upper electromagnet 12 is used to pull the armature 16 upward. This causes the pressure in the inner cavity 28 to drop below the level of the supply hydraulic fluid (i.e., motor oil) pressure. As a result a check valve 40, mounted on the lower piston 22 (or anywhere between the cavities 18, 42), opens allowing the inner cavity 18 to fully fill with fluid. The fluid then transfers from the outer cavity 42 to the inner cavity 18, urging upper piston 20 upward and thereby allowing the armature 16 to stroke and compress the armature spring 28, as shown in FIG. 3B.

Figure 4D:
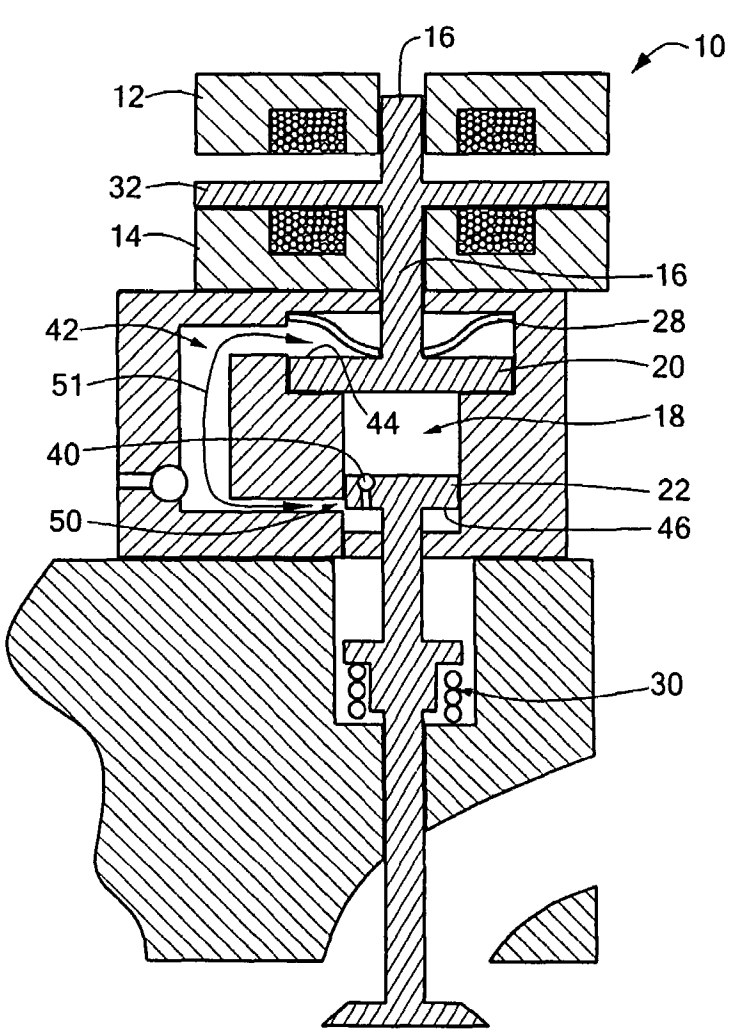
Figure 4C:
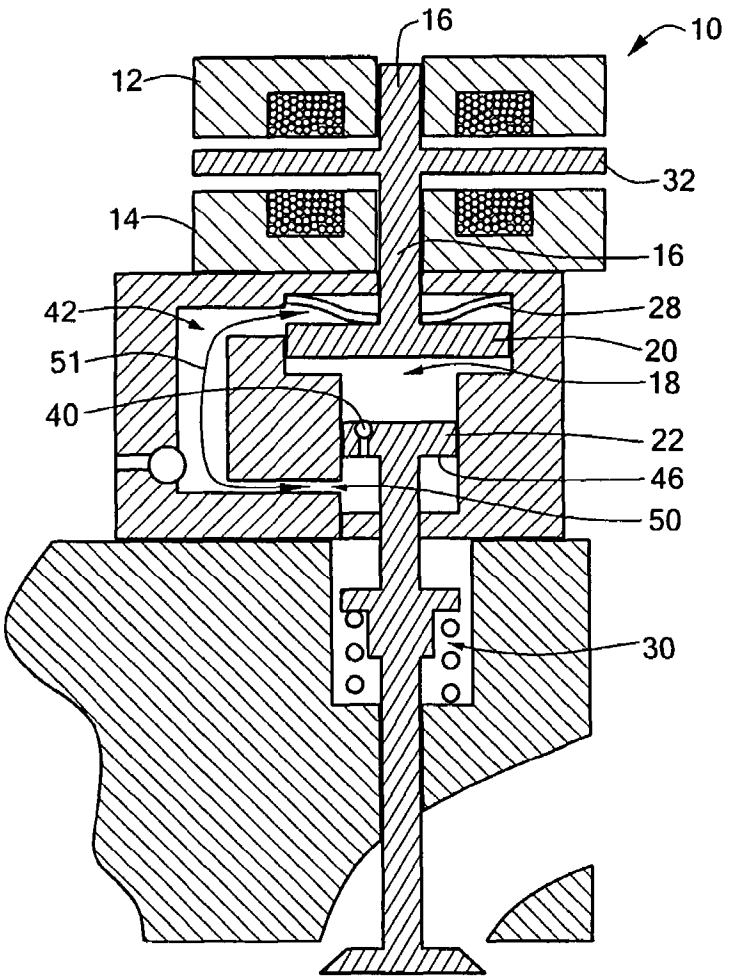

Following this initialization process, the upper electromagnet 12 is de-energized and the armature spring 28 pushes the armature 16 and upper piston 20 downward, as shown in FIG. 4C. This increases the pressure in the inner cavity 18 and closes the check valve 40. The pressure difference across the lower piston 22 causes it to move downward and compress the second spring 30. At some time during this process, the lower electromagnet 14 is energized to continue compressing the second spring 30 until the lower piston 22 strokes begins to close off an outer bypass port 50. The bypass port 50 provides hydraulic fluid porting near the end of the transition as will be described in more detail below. Suffice it to say here, however, that at this time, the second piston 22 becomes heavily damped by such hydraulic fluid passing through bypass port 50 to the outer surface 46 of the lower piston 20 and the motion reaches a low terminal velocity until the armature 16 and valve 26 reach the full open position as shown in FIG. 4D.

It is noted that the distance traveled by the lower piston 22 is a factor K times the distance traveled by the upper piston, here K is the amplification gain and is the ratio of the surface area of the upper piston 20 to the surface area of the lower piston 22, i.e., K=A1/A2. Thus, here, for example, the surface area of the upper piston 20 is twice the surface are of the lower piston 22 (i.e., K=2). Thus, when the upper piston moves downward a distance L/2 the valve moves downward a distance L. Thus, the air gap between the armature plate 16 and the electromagnet 12 is reduced by a factor of 2 in this example compared with the direct acting system of FIG. 1.

Conversely, the lower electromagnet 14 can be de-energized and the upper electromagnet 12 can be energized to reverse the process and close the valve 26.

During normal operation, proper design of the spring preloads 28, 30, damping forces, and peak magnetic forces ensures that the pressure in the inner chamber 18 is greater than the feed pressure to the outer cavity 42 during dynamic opening and closing transitions and when the valve 26 is statically held open. It is noted that the spring 28 has a stiffness greater than that of the spring 30 by the amplification gain squared, $K^2$. These, together with the design of the sizes of pistons 20, 22 and clearances, ensures that the proper volume of fluid is trapped in the inner chamber 18 to provide natural lash adjustment due to any thermal growth of the engine valve 26. When the valve 26 is in the closed position, the check valve 40 and feed hydraulic fluid (e.g., engine motor oil) provide enough flow via check valve 43 to make up for the small leakage through the annular spaces defined by the upper and lower piston 20, 22 clearances. If, for example, the leakage of fluid reduces the inner chamber 18 pressure to a value below the feed pressure, the check valve 40 opens to fill the inner chamber 18 with the correct volume of hydraulic fluid. The feed pressure is regulated based on the piston sizes and spring preloads to ensure that the valve 40 is never inadvertently opened.

As an artifact of spring-mass oscillator EVA technology, the peak operating speed that can be achieved by an EVA engine is directly related to the resonant frequency of the actuator. In an oscillating system, this resonant frequency is determined from the ratio of the effective moving mass and the effective spring constant. In a direct acting system (transmission lever ratio=1), the armature and valve can be practically viewed to move together as a single mass and the valve and armature springs can be viewed as directly additive. This is not the case when a lever is employed between the armature and valve.

Figure 5:
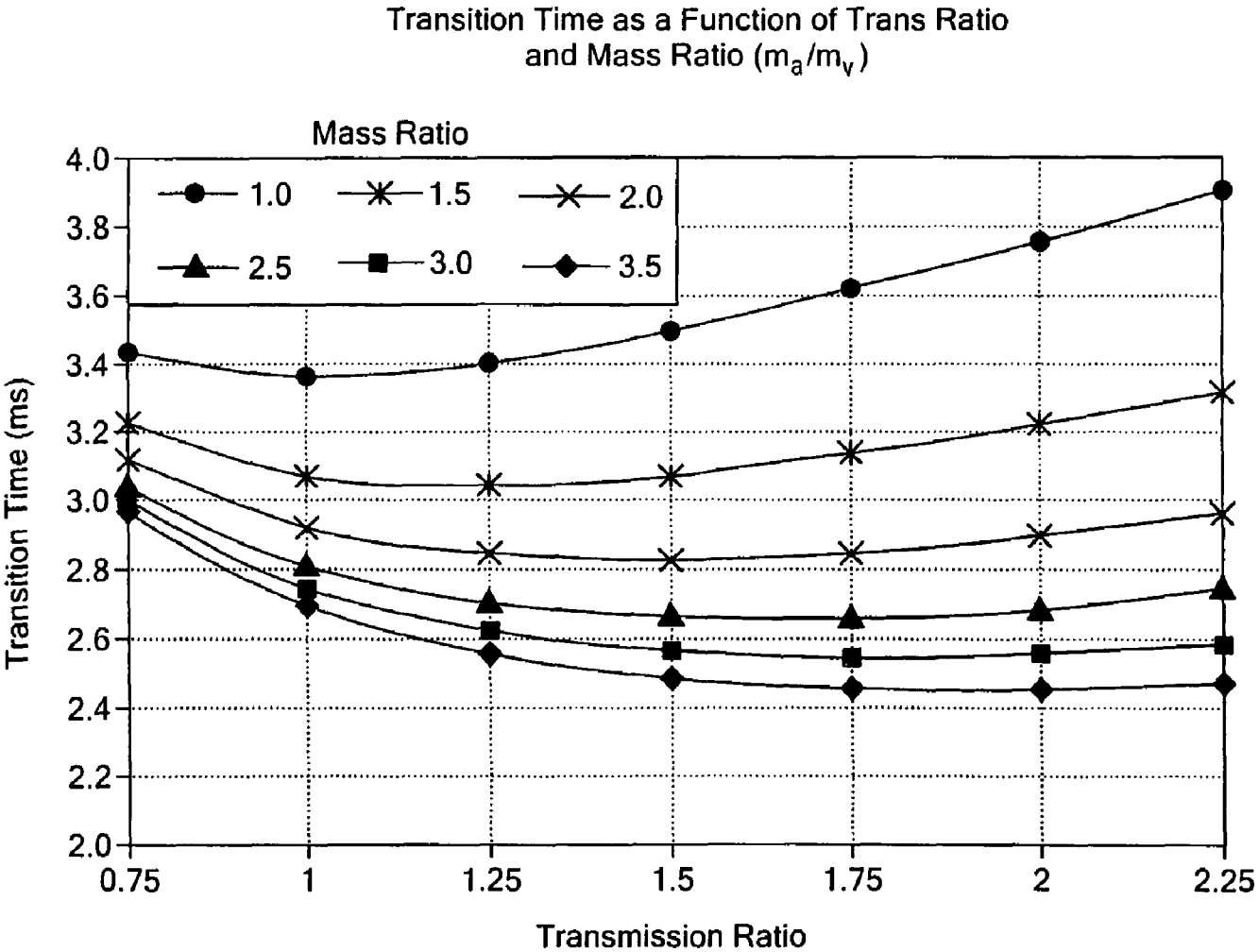
FIG. 5 is set of curves showing the relationship between transmission ratio and transient time for various ratios of the mass of an armature ($m_v$) used in the actuator of FIG. 3 and the mass of a valve ($m_v$) used in the actuator of FIG. 3.

When a lever ratio is introduced to amplify armature displacement, the armature stroke to achieve a given valve displacement is reduced, to reduce the effective armature mass by the square of the transmission ratio. Working against this effect, the mass (area) of the armature itself must be increased, due to the force-dividing lever, to hold the valve in the open and closed positions against the spring force. Thus the armature scaling to generate the required holding force works against the effective mass reduction due to the lever ratio such that for any armature mass, an optimal transmission ratio exists for minimizing transition time. This effect is illustrated in FIG. 5, where for each mass ratio (ratios of armature mass/valve mass), and optimal transmission ratio exists to minimize transmission time. Note that the lowest transition times are achieved when the mass ratio is increased (bigger armature and/or lighter valves) and the when the transmission ratio becomes bigger than one (utilize a displacement amplifier).

Figure 1:
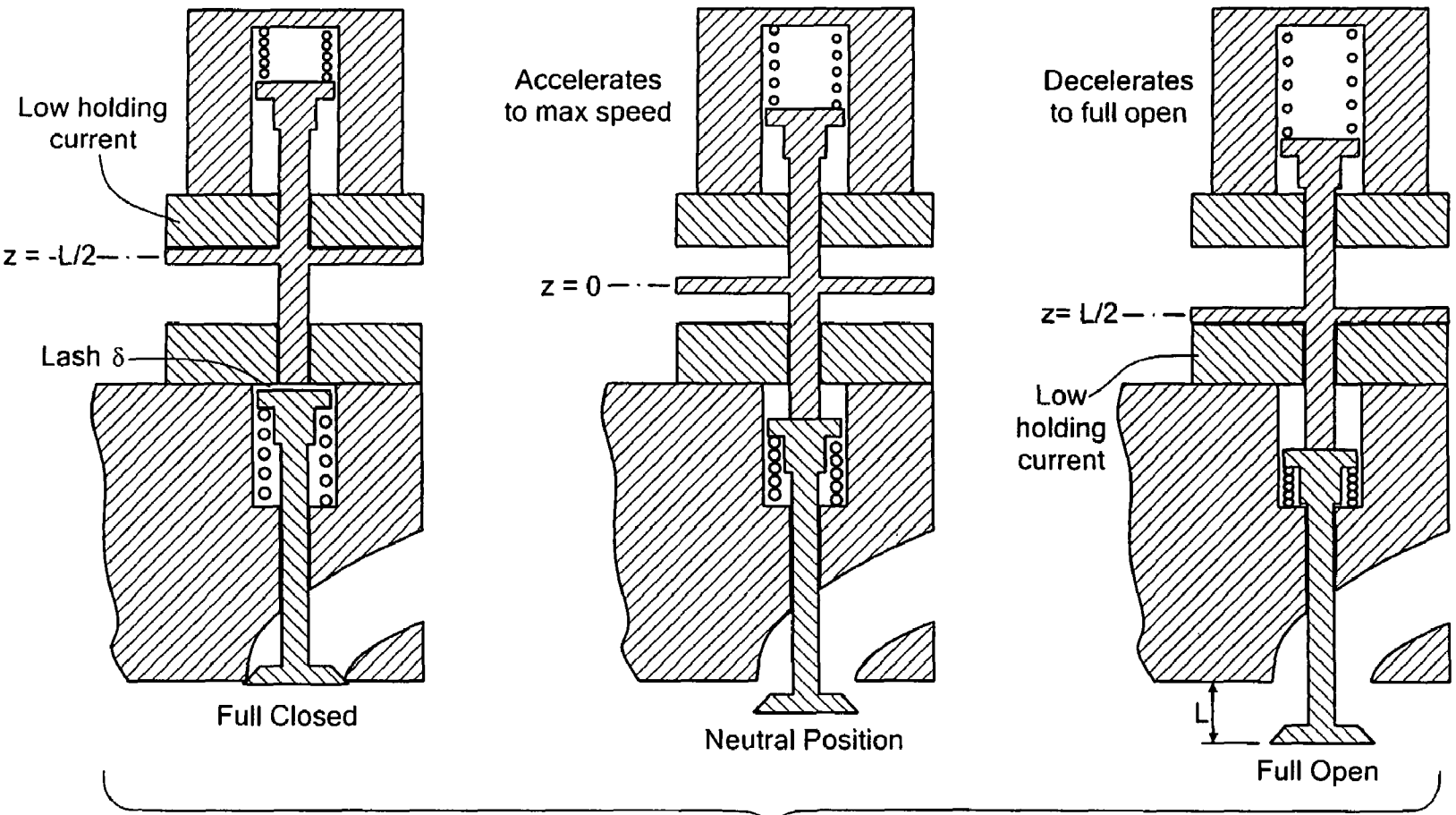
FIG. 1 PRIOR ART
FIG. 1 is an electronic valve actuator according to the PRIOR ART.
Figure 2:
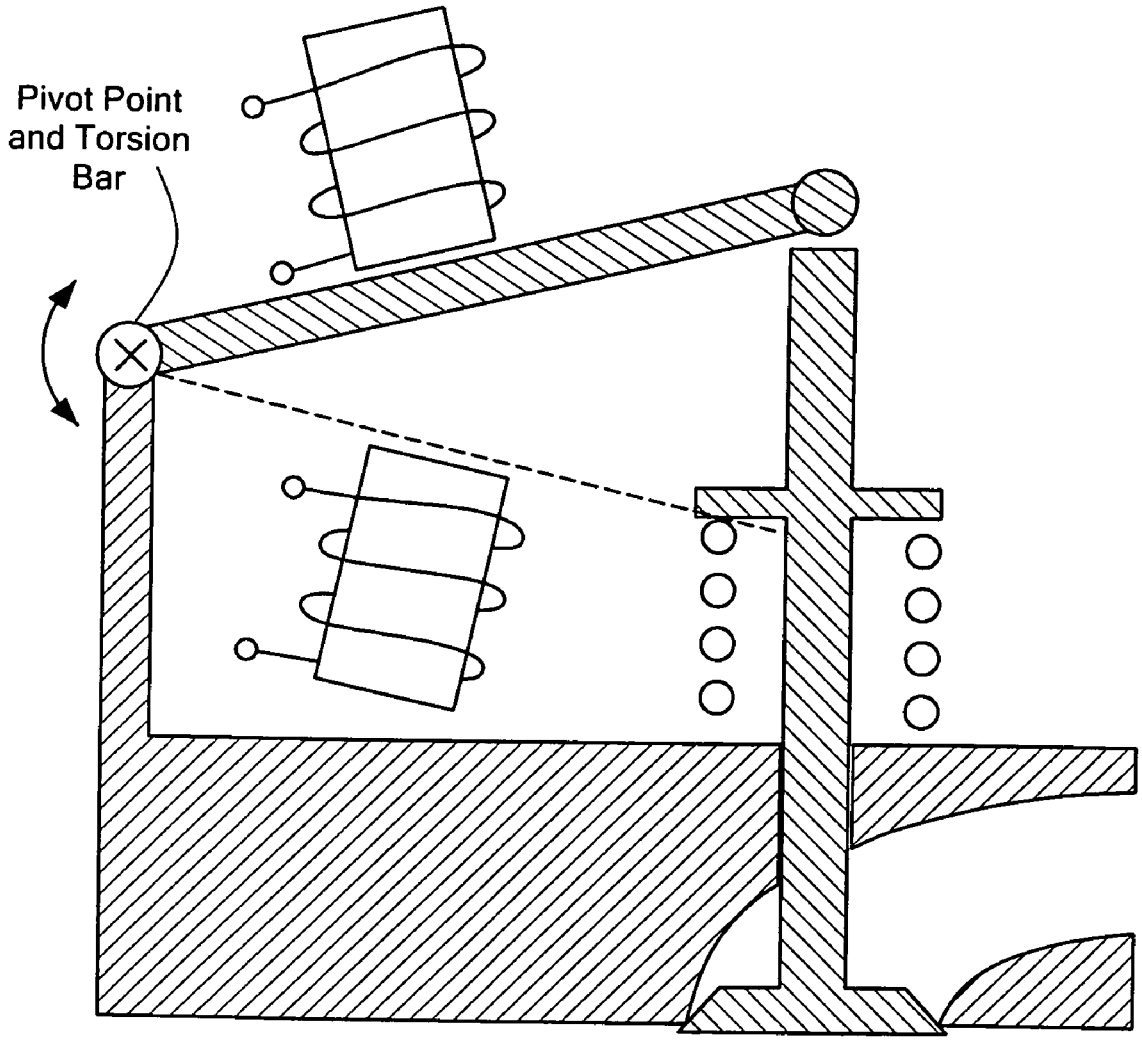
FIG. 2 PRIOR ART
FIG. 2 is another electronic valve actuator according to the PRIOR ART.

While the hydraulic displacement amplification used by the actuator 10 described above in connection with FIGS. 3 and 4A-4D can obviously allow for transmission ratio tailoring, the package flexibility of the architecture is also valuable. Because the hydraulic means is used to connect the armature 16 with the valve 26, i.e., the fluid-filled inner chamber 18, the armature 16 can be located in any orientation with respect to the valve 26. This package freedom allows for larger armatures 16 to be utilized than for the direct acting systems (FIG. 1). For example, a direct acting system with a valve spacing of 38 mm and a bore spacing of 92 mm could fill only about 83% ((2×38)/92×100%) of the available space due to the symmetry required about the valve axis. In contrast, an armature with a hydraulic displacement amplifier of FIG. 3 could be sized to fill 100% of the bore spacing or tipped on end or relocated entirely if a larger armature is desired.

Referring to the hydraulic lever implementation shown in FIG. 3, hydraulic lash control is readily achieved by designing the appropriate clearance between the support body 60 and the upper and lower pistons 20, 22. In a typical sequence of operation, the lower piston 22 strokes upward until the valve 26 is seated. The upper piston 20 then continues stroking until its travel is limited by the seating of the armature 16 or by a closing off of the hydraulic circuit 51 (FIG. 4B) that communicated fluid to the underside of the lower piston 22 (hydraulic locking) as shown in FIG. 4B. During this event, a differential pressure would develop across the upper piston 20, causing fluid to flow into the inner cavity 18 (lube feed oil feed port) through the check valve 40 and leak between the perimeter of the upper piston 20 and the support body 60 to resolve the volume displaced. Having charged the inner cavity 18, the actuation source would be able to begin opening the valve 26 with no lash.

During an opening event, downward force of the upper piston 20 creates a high pressure in the piston, i.e., inner cavity 42. This high pressure produces some flow through the check valve 40 before the valve seats and additional flow around the clearance annulus between lower piston 22 and support body 60. This results in a lower net stroke of the lower piston 22 than for the upper piston 20. Such lost stroke is actually desired to account for valve growth due to thermal effects, where the lost lift (leakage) is ideally designed to be greater than the maximum thermal growth that can occur during a given cycle.

As a tradeoff during the valve closing event, the lost lift would result in the valve landing before the upper piston 20 had finished stroking. With the natural coupling of position and velocity for the upper and lower pistons 20, 22, it is advantageous to design the leakage to be as small as possible so that the travel of the two pistons 20, 22 is nearly the same.

One significant benefit of electromagnetic valve actuators (FIG. 3) that helps in lash adjuster design is that the stroke rate is very fast and essentially constant. This is a much easier design problem than it is conventional cam valvetrains where the stroke rate is proportional to engine speed. In fact, the stroke rate of an EVA system is similar to that of a cam operating at peak speed. With such rapid and consistent stroke rates, a check-ball type system would have a very low and consistent lost lift, since the ball check will seat much quicker.

As an alternative implementation, the external check valve 48 could be removed. In this implementation, the external cavity 42 would communicate directly with the feed pressure. The internal cavity 18 would continue to regulate the relative motion between upper piston 20 and lower piston 22 in a manner similar to operation in the presence of check ball 48.

Taking advantage of the hydraulic architecture of FIG. 3, it is also simple to incorporate passive damping into the actuator. As an example, the travel of the pistons 20, 22 is damped at the travel extremes by having the pistons 20, 22 close off a bypass port 50 (FIGS. 4C and 4D), stopping the communication of hydraulic fluid (here engine motor oil to the rest of the fluid circuit 51 through outer chamber 42 between the outer surface 44 of upper piston 20 and the outer surface 46 of the lower piston 22. At this point the system would be hydraulically locked though a conservation of volume. In a further refinement, the shape of the bypass port 50 is tailored to provide a desired level of damping as a function of piston travel as described in U.S. patent application Ser. No. 10/064,897 filed Aug. 27, 2002, inventors T. Megli et al., the entire subject mater thereof being incorporated herein by reference.

Other implementations could include a ring or step extending from the piston and engaging mating cavity on the support (ram damper) or the simple design of mating flat surfaces (squeeze film). Also, the damping could be achieved using only the armature piston by using squeeze film or ram damping features on opposite sides of the armature piston. If necessary, a check valve could be incorporated into the overtravel portion of the cavity to facilitate release.

This passive, velocity-dependent damping offers significant advantages over active EVA control:

1. Reduces or eliminates the need for high speed, complex position and current feedback control of the EVA solenoids: Without passive damping, complex feedback control is required to achieve a low valve seating velocity (<0.1 m/s). Such control requires a high-speed (approximately 10-50 kHz control loop frequencies) computer and a position sensor for every valve. The required control algorithms are highly nonlinear, and will likely require adaptive or iterative learning control schemes to compensate for changes in actuator and valve characteristics over the life of the engine.
2. Improves system robustness and repeatability: The damper can be designed to remove the kinetic energy of the armature only at the ends of a valve transition to minimize the impact on transition time. Such dampers inherently compensate for changes in approach velocity due to manufacturing variability, engine wear, fluctuations in vehicle supply voltage, and changes in gas flow force disturbances.

To minimize additional power consumption and eliminate the need for position sensors, the landing energy could be contained in a reasonably small envelope by using a simple current feedback controller, where current would be used as a secondary indicator of position. The damper would be designed to absorb only the residual landing energy and contain the uncertainty of the controller. This combination of damper and simple controller would prevent the risk of "losing valves" (magnet fails to "catch" valve) or landing them too hard (which leads to physical damage), while reducing power consumption relative to a system with an open-loop controller/damper.

A number of embodiments of the invention have been described. Nevertheless, it will be understood that various modifications may be made without departing from the spirit and scope of the invention. Accordingly, other embodiments are within the scope of the following claims.

What is claimed is:

1. An electronic valve actuator, comprising:

an electromagnet;

an armature disposed adjacent to the electromagnet;

a fluid-containing chamber having:

a first piston providing a first wall portion of the chamber, such first piston being movable in the chamber along a direction of motion, such first wall portion having a first projected surface area, such first projected surface area being the surface area of the first wall portion projected onto a plane normal to the direction of motion of the first piston; and a second piston providing a second wall portion of the chamber, such second piston being movable in the chamber along a direction of motion, such second wall portion having a second projected surface area, such second projected surface area being the surface area of the second wall portion projected onto a plane normal to the direction of motion of the second piston, the first projected wall portion being different from the second projected surface area; and wherein the first piston is coupled to the armature and the second piston is coupled to a valve.

2. The electronic valve actuator recited in claim 1 wherein the valve is a valve of an internal combustion engine.

3. The electronic valve actuator recited in claim 2 wherein the chamber has therein motor oil for the engine.

4. The electronic valve actuator recited in claim 1 including a valve disposed in the wall of the fluid-containing chamber for enabling such chamber to receive fluid when volume of such chamber is increased by activation of one of electromagnets to move one of the pistons in a first direction and to inhibit removal of such fluid from the chamber when volume of such chamber is decreased by activation of said one of the pistons in an opposite direction.

5. An electronic valve actuator, comprising:

a pair of electromagnets;

an armature disposed in a magnetic field produced by the pair of electromagnets;

a fluid-containing chamber having:

a first piston providing a first wall portion of the chamber, such first piston being movable in the chamber along a direction of motion, such first wall portion having a first projected surface area, such first projected surface area being the surface area of the first wall portion projected onto a plane normal to the direction of motion of the first piston; and a second piston providing a second wall portion of the chamber, such second piston being movable in the chamber along a direction of motion, such second wall portion having a second projected surface area, such second projected surface area being the surface area of the second wall portion projected onto a plane normal to the direction of motion of the second piston, the first projected surface area being different from the second projected surface area; and wherein the first piston is coupled to the armature and the second piston is coupled to a valve;

a pair of springs, a first one of the pair of springs is disposed to compress upon activation of a first one of the pair of electromagnets while a second one of such pair of springs is disposed to expand upon such activation of the first one of the pair of electromagnets, the first one of the springs being held in compression until deactivation of the first one of the electromagnets, the second one of the pair of springs being disposed to compress after deactivation of the first one of the electromagnets and resulting expansion of the first one of the pair of springs while the first one of such pair of springs is disposed to thereby expand, the second one of the springs being held in compression until deactivation of the second one of the electromagnets.

6. The electronic valve actuator recited in claim 5 including a valve disposed in the wall of the fluid-containing chamber for enabling such chamber to receive fluid when volume of such chamber is increased by activation of one of electromagnets to move one of the pistons in a first direction and to inhibit removal of such fluid from the chamber when volume of such chamber is decreased by activation of said one of the pistons in an opposite direction.

7. The electronic valve actuator recited in claim 6 including a second fluid-containing chamber providing a conduit for fluid therein to pass between an outer surface portion of the first piston and an outer surface portion of the second piston as the first and second pistons move in response to activation of the first and second ones of the pair of electromagnets.

8. The electronic valve actuator recited in claim 6 wherein the fluid in the second chamber passes to the first-mentioned fluid-containing chamber through the valve.

9. An electronic valve actuator, comprising:

an electromagnet;

an armature disposed adjacent to the electromagnet;

a fluid-containing chamber having:

a first piston providing a first wall portion of the chamber, such first piston being movable in the chamber along a direction of motion, such first wall portion having a first projected surface area, such first projected surface area being the surface area of the first wall port ion projected onto a plane normal to the direction of motion of the first piston; and a second piston, spaced from the first piston, providing a second wall portion of the chamber, such second piston being movable in the chamber along a direction of motion, such second wall portion having a second projected surface area, such second projected surface area being the surface area of the second wall portion projected onto a plane normal to the direction of motion of the second piston, the first projected surface area being different from, the second projected surface area;

wherein the first piston is coupled to the armature and the second piston is coupled to a valve; and wherein motion of the first piston is coupled to the second piston through fluid in the fluid-containing chamber.

10. The electronic valve actuator recited in claim 9 wherein the valve is a valve of an internal combustion engine.

11. The electronic valve actuator recited in claim 10 wherein the chamber has therein motor oil for the engine.

12. The electronic valve actuator recited in claim 9 including a valve disposed in the wall of the fluid-containing chamber for enabling such chamber to receive fluid when volume of such chamber is increased by activation of one of electromagnets to move one of the pistons in a first direction and to inhibit removal of such fluid from the chamber when volume of such chamber is decreased by activation of said one of the pistons in an opposite direction.

13. An electronic valve actuator, comprising:

a pair of electromagnets;

an armature disposed in a magnetic field produced by the pair of electromagnets;

a fluid-containing chamber having:

a first piston providing a first wall portion of the chamber, such first piston being movable in the chamber along a direction of motion, such first wall portion having a first projected surface area, such first projected surface area being the surface area of the first wall portion projected onto a plane normal to the direction of motion of the first piston; and a second piston, spaced from the first piston, providing a second wall portion of the chamber, such second piston being movable in the chamber along a direction of motion, such second wall portion having a second projected surface area, such second projected surface area being the surface area of the second wall portion projected onto a plane normal to the direction of motion of the second piston, the first projected surface area being different from the second projected surface area;

wherein the first piston is coupled to the armature and the second piston is coupled to a valve; and wherein motion of the first piston is coupled to the second piston through fluid in the fluid-containing chamber;

a pair of springs, a first one of the pair of springs is disposed to compress upon activation of a first one of the pair of electromagnets while a second one of such pair of springs is disposed to expand upon such activation of the first one of the pair of electromagnets, the first one of the springs being held in compression until deactivation of the first one of the electromagnets, the second one of the pair of springs being disposed to compress after deactivation of the first one of the electromagnets and resulting expansion of the first one of the pair of springs while the first one of such pair of springs is disposed to thereby expand, the second one of the springs being held in compression until deactivation of the second one of the electromagnets.

14. The electronic valve actuator recited in claim 13 including a valve disposed in the wall of the fluid-containing chamber for enabling such chamber to receive fluid when volume of such chamber is increased by activation of one of electromagnets to move one of the pistons in a first direction and to inhibit removal of such fluid from the chamber when volume of such chamber is decreased by activation of said one of the pistons in an opposite direction.

15. The electronic valve actuator recited in claim 14 including a second fluid-containing chamber providing a conduit for fluid therein to pass between an outer surface portion of the first piston and an outer surface portion of the second piston as the first and second pistons move in response to activation of the first and second ones of the pair of electromagnets.

16. The electronic valve actuator recited in claim 15 wherein the fluid in the second chamber passes to the first-mentioned fluid-containing chamber through the valve.

* * * * *